US005097874A

United States Patent [19]

Bobren

[11] Patent Number: 5,097,874

[45] Date of Patent: Mar. 24, 1992

[54] STRAPPING HEAD WITH STRAP TAIL-FLATTENING CAPABILITY

[75] Inventor: Allan J. Bobren, Streamwood, Ill.

[73] Assignee: Signode Corporation, Glenview, Ill.

[21] Appl. No.: 686,504

[22] Filed: Apr. 7, 1991

[51] Int. Cl.[5] ..... B21F 11/00

[52] U.S. Cl. ..... 140/93.2; 140/123.6; 140/152

[58] Field of Search ..... 140/93.2, 93.4, 123.6, 140/150, 152

[56] References Cited

U.S. PATENT DOCUMENTS 2,801,558 8/1957 Crosby et al. ..... 140/152
3,241,579 3/1966 Partridge ..... 140/93.2
4,791,968 12/1988 Pearson .
4,825,512 5/1989 Tremper et al. .

*Primary Examiner*—Lowell A. Larson

*Attorney, Agent, or Firm*—T. W. Buckman; D. J. Breh

[57] ABSTRACT

In a strapping head, slitting dies and a slitting punch on a punch holder cooperate to make a sealless connection in two overlapped layers of a tensioned loop of steel strap. A sealing yoke moves the punch holder via a connection allowing lost motion between the sealing yoke and the punch holder. A strap cutter on a cutter holder and an anvil cooperate to cut an outer layer of the tensioned loop. The sealing yoke moves the cutter holder via a connection allowing lost motion between the sealing yoke and the cutter holder. A spring member biases the strap cutter in a forward direction, via a plunger engaging the strap cutter upon forward motion of the sealing yoke for a sufficient distance to take up lost motion between the sealing yoke and the cutter holder, whereby overtravel of the strap cutter flattens the strap tail.

9 Claims, 3 Drawing Sheets

STRAPPING HEAD WITH STRAP TAIL-FLATTENING CAPABILITY

TECHNICAL FIELD OF THE INVENTION

This invention pertains to a strapping head with an improved capability for flattening a strap tail, such as a strapping head for a powered strapping machine of a type used to make a sealless connection in two overlapped layers of steel strap in a tensioned loop. Overtravel of a strap cutter, which is biased in a forward direction, results in the strap tail being flattened against an adjacent portion of the tensioned loop.

BACKGROUND OF THE INVENTION

A strapping head for a strapping machine of the type noted above is exemplified in Pearson U.S. Pat. No. 4,791,968. The strapping head is designed to make a sealless connection in two overlapped layers of steel strap in a tensioned loop, such as the reverse-lock notch or sealless connection exemplified in Tremper et al. U.S. Pat. No. 4,825,512. As exemplified in the Tremper et al. patent, a sealless connection is made from slits, which are punched into the overlapped layers. The slits form interlockable shoulders, which interlock when the loop is released under retained tension.

Generally, as disclosed in the Pearson patent noted above, a set of slitting dies on a pair of pivotally mounted sealing jaws and a longitudinally movable punch on a punch holder cooperate and are adapted to make a sealless connection in two overlapped layers of steel strap in a tensioned loop. A longitudinally movable sealing yoke pivots the sealing jaws by means of cams on the sealing yoke and moves the punch holder via a connection allowing lost motion between the sealing yoke and the punch holder. A pair of pivotally mounted notching cutters on a longitudinally movable notching cutter holder cooperate and are adapted to cut notches in opposite edges of the overlapped layers after the sealless connection has been made. A longitudinally movable notching yoke pivots the notching jaws by means of links and moves the notching cutter holder via a connection allowing lost motion between the notching yoke and the notching cutter holder. The sealing and notching yokes are arranged such that the sealing yoke moves the notching yoke for certain purposes. Strap-cutting elements including a strap cutter are provided, which are adapted to cut the tensioned loop from the remaining strap.

In a sealless connection, in which the overlapped layers include an inner layer and an outer layer, the outer layer is cut from the remaining strap near the slits punched into the outer layer so as to leave a cut end of the outer layer. The outer layer is cut by movable cutter coacting with a stationary cutter. A short portion of the outer layer is left between the cut end and the slits punched into the outer layer and is designated as a strap tail. A common problem is that the strap tail tends to curl outwardly near the cut end due to the stationary cutter acting to separate the outer and inner layers, which thus tends to snag on nearby objects. Such a problem is encountered not only with strapping heads of powered strapping machines of the type noted above, but also with strapping heads of powered strapping machines used to apply metal seals to two overlapped layers of steel strap in a tensioned loop, and also with manual strapping tools.

Prior efforts to deal with the aforenoted problem have focused on flattening the strap tail by causing overtravel of the strap cutter, beyond a point where the outer layer has been cut, before the overlapped layers have been connected. However, those efforts have not been entirely satisfactory, particularly in powered strapping machines of the type noted above. If strap tension is lessened when the outer layer is cut, residual tension may be too small to cause the interlockable shoulders to interlock reliably, which may result in total loss of strap tension and in the outer layer pulling completely out of the sealling mechanism. It may be then necessary to grip the overlapped layers so as to prevent tension loss while the outer layer is being cut or to use separate actuators for sealing and for cutting. If a single actuator is used for sealing and for cutting, optimum final positions of the sealing elements are defined within a narrow window, which does not allow overtravel of the strap cutter for a sufficient distance to flatten the strap tail satisfactorily.

There has been a need, to which this invention is addressed, for an improved mechanism for a strapping head for flattening a strap tail, in a strapping machine of the type noted above.

SUMMARY OF THE INVENTION

Generally, this invention provides improvements in a strapping head for a strapping machine, in which a sealless or other connection is made in two overlapped layers of steel strap in a tensioned loop. The overlapped layers include an inner layer and an outer layer. A strap tail is left when the tensioned loop is cut from the remaining strap. A strap cutter, which is biased in a forward direction, overtravels for a sufficient distance to flatten the strap tail against an adjacent portion of the tensioned loop.

Broadly, in a strapping head according to this invention, a sealing yoke is mounted so as to permit longitudinal motion of the sealing head in a forward direction and in a reverse direction, and a mechanism is provided for cutting the outer layer of steel strap so as to cut the tensioned loop from the remaining strap and so as to leave a strap tail. The cutting mechanism comprises a cutting anvil and a strap cutter. The cutting anvil is mounted in the strapping head, in a fixed position, and is positionable between the inner and outer layers of steel strap. The strap cutter is mounted in the strapping head so as to permit longitudinal motion of the strap cutter relative to the sealing yoke in the forward direction and in the reverse direction. The strap cutter is adapted to cooperate with the cutting anvil to cut the outer layer of steel strap upon longitudinal motion of the strap cutter past the cutting anvil in the forward direction.

The strap cutter is connected to the sealing yoke so as to allow lost motion between the strap cutter and the sealing yoke. Longitudinal motion of the sealing yoke relative to the strap cutter in the forward direction for a sufficient distance to completely take up lost motion between the sealing yoke and the strap cutter effects longitudinal motion of the strap cutter in the forward direction. A mechanism is provided for biasing the strap cutter in the forward direction upon longitudinal motion of the sealing yoke in the forward direction for a sufficient distance to substantially take up lost motion between the sealing yoke and the strap cutter. The biasing mechanism biases the strap cutter so as to cause the strap cutter to overtravel for a sufficient distance to flatten the strap tail against an adjacent portion of the tensioned loop, after the outer layer of steel strap has been cut.

In a strapping head of the type noted above with improvements provided by this invention, a set of slitting dies are mounted in the strapping head and are positionable behind the inner layer of steel strap. The sealing yoke is mounted in the strapping head, as described above, so as to permit longitudinal motion of the sealing yoke relative to the slitting dies in a forward direction and in a reverse direction. A slitting punch is mounted in the strapping head, preferably via a punch holder connected to the sealing yoke in a manner described below, so as to permit longitudinal motion of the slitting punch relative to the sealing yoke in the forward direction, toward the slitting dies, and in the reverse direction, away from the slitting dies. A mechanism is provided, as described above, for cutting the outer layer of steel strap.

The slitting punch is connected to the sealing yoke so as to allow lost motion between the sealing yoke and the slitting punch. The strap cutter is connected to the sealing yoke so as to allow lost motion between the sealing yoke and the strap cutter. Relative motion between the slitting punch and the strap cutter is allowed. The slitting punch is connected to the sealing yoke such that longitudinal motion of the sealing yoke relative to the slitting punch, in the forward direction for a sufficient distance to completely take up lost motion between the sealing yoke and the slitting punch, effects longitudinal motion of the punch holder in the forward direction. Also, as described above, the strap cutter is connected to the sealing yoke such that longitudinal motion of the sealing yoke relative to the strap cutter, in the forward direction for a sufficient distance to completely take up lost motion between the sealing yoke and the strap cutter, effects longitudinal motion of the strap cutter in the forward direction. A mechanism is provided, as described above, for biasing the strap cutter in the forward direction upon longitudinal motion of the sealing yoke in the forward direction for a sufficient distance to take up lost motion between the sealing yoke and the strap cutter.

Preferably, the cutting mechanism comprises a punch holder and a cutter holder, as mentioned above. The punch holder is connected to the sealing yoke so as to permit longitudinal motion of the punch holder relative to the sealing yoke, in the forward direction and in the reverse direction, and the slitting punch is mounted to the punch holder so as to be conjointly movable with the punch holder. The cutter holder is connected to the sealing yoke so as to permit longitudinal motion of the cutter holder relative to the sealing yoke, in the forward direction and in the reverse direction, and the strap cutter is mounted to the cutter holder so as to be conjointly movable with the cutter holder. Moreover, the punch holder has a longitudinal slot or longitudinal slots, and the cutter holder has a longitudinal slot. The longitudinal slots have equal or unequal lengths. A pin, which is mounted to the sealing yoke so as to be conjointly movable with the sealing yoke, extends through the longitudinal slot or longitudinal slots of the punch holder and through the longitudinal slot of the cutter holder so as to allow lost motion between the sealing yoke and the slitting punch and between the sealing yoke and the strap cutter within limits defined by the respective slots.

In a preferred arrangement, the sealing yoke has walls defining a recess, which accommodates a portion of the cutter holder so as to allow lost motion of the cutter holder relative to the sealing yoke, and the sealing yoke has a spring retainer, which is integral with the sealing yoke. One such wall has a longitudinally extending aperture defining an axis. Also, in the preferred arrangement, a plunger extends through the longitudinally extending aperture so as to be axially movable between an advanced position and a retracted position. The plunger has a working portion, which projects into the recess in the advanced position and which is adapted to engage the cutter holder, at the portion accommodated by the recess, upon longitudinal motion of the sealing yoke in the forward direction for a sufficient distance to substantially take up lost motion between the sealing yoke and the cutter holder. The plunger has a boss portion, which is adapted to engage such one wall so as to limit axial motion of the plunger toward the advanced position. Moreover, in the preferred arrangement, a spring structure is loaded between the spring retainer and the boss portion so as to bias the pin toward the advanced position.

Preferably, the plunger has a stem portion, which extends from the boss portion. Thus, the spring structure can be alternatively provided by a coiled wire spring member disposed around the stem portion, between the spring retainer and the boss portion, by a stack of belleville washers disposed similarly, or by a tubular, elastomeric member disposed similarly.

In one contemplated arrangement, a mechanism is provided for latching the cutter holder to the sealing yoke and for unlatching the cutter holder from the sealing yoke, under certain conditions. Such mechanism latches the cutter holder to the sealing yoke, so as to prevent relative motion between the cutter holder and the sealing yoke, upon longitudinal motion of the sealing yoke relative to the cutter holder in the forward direction for a sufficient distance to at least substantially take up lost motion between the sealing yoke and the cutter holder, allowing cutoff to occur without allowing the cutter to overtravel. Such mechanism unlatches the cutter holder from the sealing yoke, so as to allow relative motion between the cutter holder and the sealing yoke, upon longitudinal motion of the sealing yoke in the reverse direction from a position where lost motion between the sealing yoke and the cutter holder has been taken up at least substantially.

Preferably, the latching and unlatching mechanism comprises a latching member, which is mounted to the sealing yoke so as to be pivotally movable between a latching position and an unlatching position. In the latching position, the latching member extends into the longitudinal slot of the cutter holder and engages the cutter holder so as to prevent relative motion between the cutter holder and the sealing yoke. In the unlatching position, the latching member allows relative motion between the cutter holder and the sealing yoke. Moreover, the latching member is biased to the cutter holder, as by a torsional spring. Provisions are made, furthermore, for camming the latching member from the latching position into the unlatching position upon reverse longitudinal motion of the sealing yoke from the position where lost motion between the sealing yoke and the cutter holder has been taken up completely.

These and other objects, features, and advantages of this invention are evident from the following description of a preferred embodiment of this invention and two alternate embodiments, with reference to the accompanying drawings.

DETAILED DESCRIPTION OF ILLUSTRATED EMBODIMENTS

Figure 1:
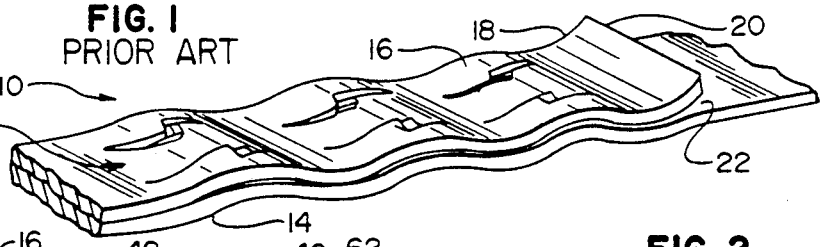
FIG. 1 PRIOR ART
FIG. 1 is a fragmentary, perspective view of a sealless connection in two overlapped layers of steel strap in a tensioned loop. The sealless connection is illustrated in a simplified manner. A strap tail is shown, which is curled upwardly at a cut end.

The aforenoted problem is illustrated in FIG. 1, in which a tensioned loop 10 of steel strap is shown as having a sealless connection 12 in two overlapped layers of steel strap, namely an inner layer 14 and an outer layer 16. The sealless connection 12 represents any sealless connection known heretofore, such as the reverse-lock notch or sealless connection disclosed in Tremper et al. U.S. Pat. No. 4,825,512. A strap tail 18 is left between the sealless connection 12 and a cut end 20 of the outer layer 16 of steel strap when the tensioned loop 10 is cut from the remaining strap. The strap tail 18 is curled outwardly near the cut end 20, away from an adjacent portion 22 of the tensioned loop 10, so as to have a tendency to snag on nearby objects.

Figure 2:
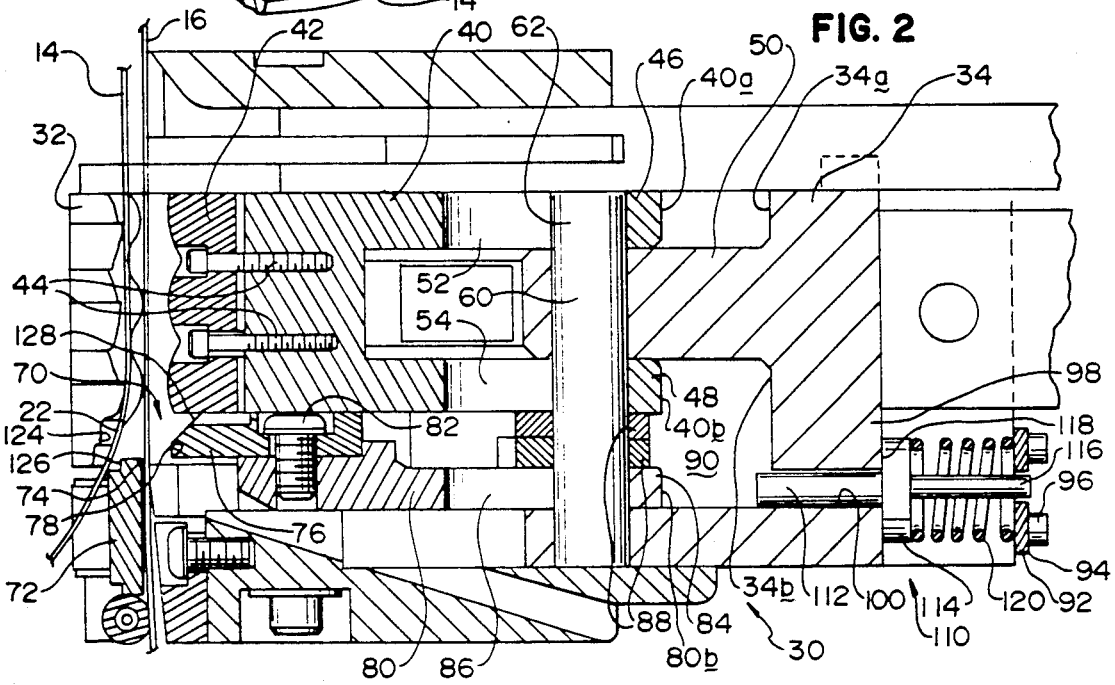
FIG. 2 is a fragmentary, cross-sectional view of certain elements of a strapping head constituting a preferred embodiment of this invention. Among other elements, a sealing yoke, a slitting punch, and a strap cutter are shown before slits are punched in two overlapped layers of steel strap in a tensioned loop.
Figure 3:
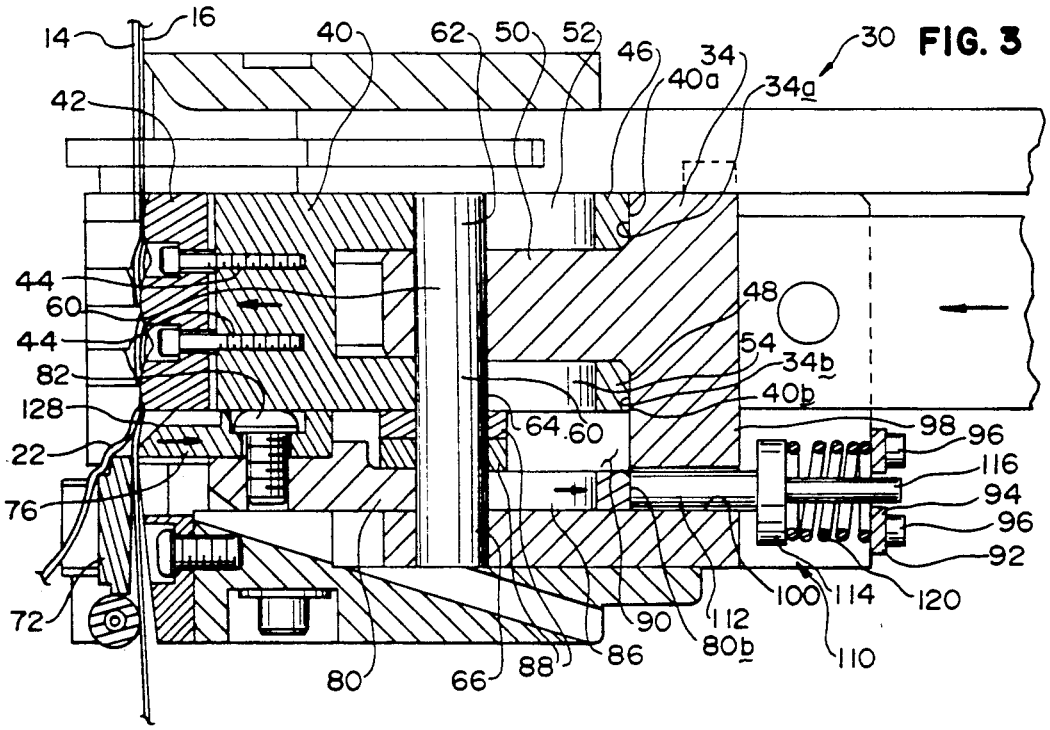
FIG. 3 is a comparable view showing the sealing yoke, the slitting punch, and the strap cutter, among other elements, after slits have been punched in the overlapped layers but before the tensioned loop is cut from the remaining strap.
Figure 4:
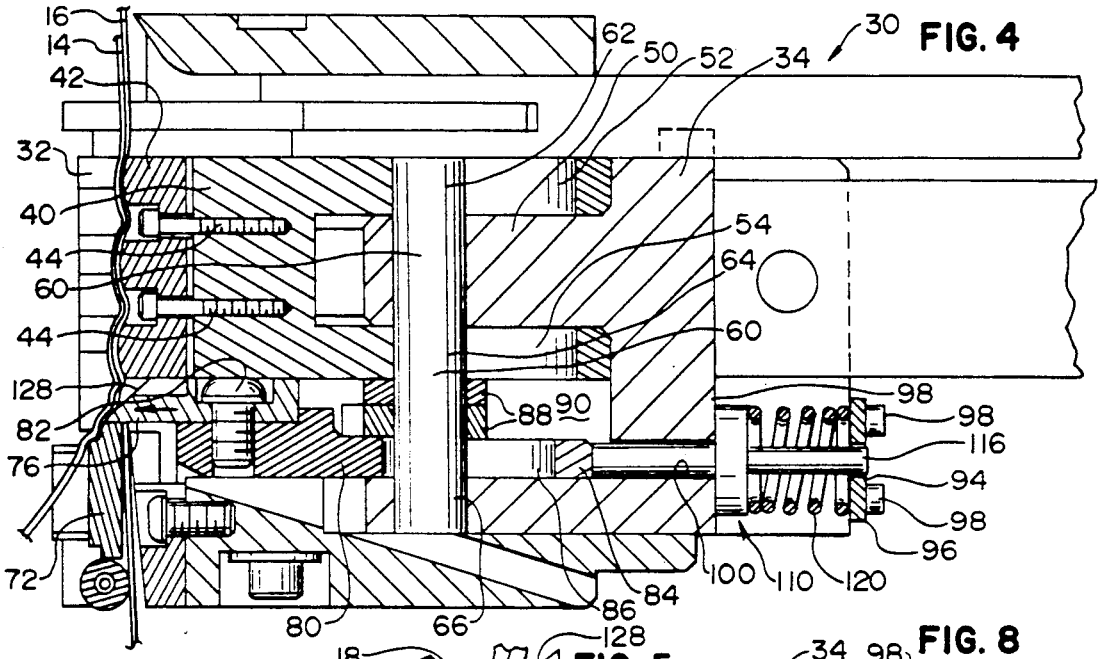
FIG. 4 is a comparable view showing the sealing yoke, the slitting punch, and the strap cutter, among other elements, after the tensioned loop has been cut from the remaining strap so as to leave a strap tail and after the strap tail has been flattened against an adjacent portion of the tensioned loop.

This invention addresses the aforenoted problem by providing an improved capability for flattening a strap tail, such as the strap tail 18, in a strapping head, such as the strapping head 30 shown in FIGS. 2, 3, and 4. The strapping head 30, of a type used to make a sealless connection in two overlapped layers of steel strap in a tensioned loop, constitutes a preferred embodiment of this invention. Except as illustrated and described herein, the strapping head 30 is similar to the strapping head disclosed in Pearson U.S. Pat. No. 4,791,968, the disclosure of which is incorporated herein by reference. The strapping head 30 is powered by a two-stage (double acting) pneumatic piston-and-cylinder mechanism (not shown) similar to the two-stage pneumatic piston-and-cylinder mechanism disclosed in the Pearson patent.

It is convenient herein to describe the strapping head 30 as used to make the sealless connection 12 in the overlapped layers 14, 16, of steel strap in the tensioned loop 10 and to flatten the strap tail 18 against the adjacent portion 22 of the tensioned loop 10. As made by the strapping head 30, the sealless connection 12 may conform to the reverse-lock notch or sealless connection disclosed in Tremper et al. U.S. Pat. No. 4,825,512, the disclosure of which is incorporated herein by reference.

The strapping head 30 comprises a set of slitting dies 32, which are mounted operatively in the strapping head 30 and which are positionable behind the inner layer 14 of steel strap, in a manner disclosed in the Pearson patent. A sealing yoke 34 is mounted operatively in the strapping head 30, in a manner disclosed in the Pearson patent, so as to permit longitudinal motion of the sealing yoke 34 relative to the slitting dies 32 between an extended position of the sealing yoke 34 and a withdrawn position of the sealing yoke 34. The sealing yoke 34 is shown in the withdrawn position in FIG. 2 and in the extended position in FIGS. 3 and 4. The sealing yoke 34 is connected to the two-stage pneumatic piston and cylinder mechanism noted above, in a manner disclosed in the Pearson patent, so as to be power-driven from the withdrawn position to the extended position and vice-versa.

A punch holder 40, to which a slitting punch 42 is mounted via screws 44 so as to be conjointly movable with the punch holder 40, is connected to the sealing yoke 34 so as to permit longitudinal motion of the slitting punch 42 relative to the sealing yoke 34 in a forward direction, toward the slitting dies 32, and in a reverse direction, away from the slitting dies 32. When the slitting punch 42 is moved toward the slitting dies 32 for a sufficient distance, the slitting punch 42 and the slitting dies 32 cooperate to punch slits for the sealless connection 12 in the overlapped layers 14, 16, of steel strap.

The punch holder 40 has two rearwardly extending portions 46, 48, between which a portion 50 of the sealing yoke 34 extends. The punch holder portion 46 has an elongated, longitudinal slot 52 and the punch holder portion 48 has an elongated, longitudinal slot 54. Each of the slots 52, 54, has two semi-circular ends and has a similar length. A pin 60 of circular cross-section conforming to the semi-circular ends of the slots 52, 54, is mounted to the sealing yoke 34, at the portion 50 extending between the punch holder portions 46, 48, so as to be conjointly movable with the sealing yoke 34. The pin 60 extends through the slot 52, at an end portion 62 of the pin 60, and through the slot 54, at an intermediate portion 64 of the pin 60, so as to permit lost motion between the sitting punch 42, as mounted to the punch holder 40, and the sealing yoke 34 within limits defined by the slots 52, 54. The pin 60 has an end portion 66 opposite to the end portion 62.

The strapping head 30 comprises a mechanism 70 for cutting the outer layer 16. The cutting mechanism 70 comprises a cutting anvil 72 having a sharp corner 74 and a strap cutter 76 having a sharp corner 78. The cutting anvil 72 is fixed in the strapping head 30, in a known manner, and is positionable between the inner layer 14 and the outer layer 16. The strap cutter 76 is mounted to the sealing yoke 34, via a cutter holder 80, so as to permit longitudinal motion of the strap cutter 76 relative to the sealing yoke 34 in the forward direction and in the reverse direction. The strap cutter 76 is adapted to cooperate with the cutting anvil 72 to cut the outer layer 16 at the sharp corners 74, 78, upon longitudinal motion of the strap cutter 76 past the cutting anvil 72 in the forward direction. The strap cutter 76 and the cutting anvil 72 are shown in FIG. 3 as about to cut the outer layer 16.

The cutter holder 80, to which the strap cutter 76 is mounted via a screw 82 so as to be conjointly movable with the cutter holder 80, is mounted in the strapping head 30 so as to permit longitudinal motion of the cutter holder 80 and the strap cutter 76 relative to the sealing yoke 34 in a forward direction toward the slitting dies 32 and in a reverse direction away from the slitting dies 32. The cutter holder 80 has a rearwardly extending portion 84 having an elongate, longitudinal slot 86, which is similar to the longitudinal slots 52, 54, of the punch holder portions 46, 48, and which has similar lateral and longitudinal dimensions including a similar length and similar semicircular ends. It is not necessary for the slot 86 and the slots 52, 54, to have similar lengths. The pin 60 extends through the slot 86, at the end portion 66, so as to allow lost motion between the strap cutter 76, as mounted to the cutter holder 80, and the sealing yoke 34 within limits defined by the slot 86. The rearwardly extending portion 48 of the punch holder 40 and the rearwardly extending portion 84 of the cutter holder 80 are separated by two links 88, which cooperate with the pin 60 for purposes described in the Pearson patent, outside the scope of this invention.

Thus, via the pin 60 and the punch holder 40, the slitting punch 42 is connected to the sealing yoke 34 so as to allow lost motion between the sealing yoke 34 and the slitting punch 42 over a limited range within limits defined by the slots 52, 54. Also, via the pin 60 and the cutter holder 80, the strap cutter 76 is connected to the sealing yoke 34 so as to allow lost motion between the sealing yoke 34 and the strap cutter 76 over a limited range, within limits defined by the slot 86. Further, because the strap cutter 76 and the slitting punch 42 are connected independently to the sealing yoke 34, relative motion between the strap cutter 76 and the slitting punch 42 is allowed.

Moreover, via the pin 60 and the punch holder 40, the slitting punch 42 is connected to the sealing yoke 34 in such manner that longitudinal motion of the sealing yoke 34 relative to the punch holder 40 and the slitting punch 42 from the withdrawn position (FIG. 1) in the forward direction for a sufficient distance to completely take up lost motion between the sealing yoke 34 and the punch holder 40 (and thus between the sealing yoke 34 and the slitting punch 42) effects longitudinal motion of the slitting punch 42 in the forward direction. The punch holder 40 and the slitting punch 42 are driven conjointly in the forward direction by direct contact between the sealing yoke 34 (at two surfaces **34*a*, 34*b*, which face the punch holder 40) and the punch holder 40 (at two surfaces 40*a*, 40*b*, which face the sealing yoke 34) when lost motion therebetween has been taken up completely. The sealing yoke 34, the punch holder 40, and the slitting punch 42 are shown in FIGS. 3 and 4 in positions where lost motion between the sealing yoke 34 and the punch holder 40 has been taken up completely from longitudinal motion of the sealing yoke 34 relative to the punch holder 40 and the slitting punch 42** in the forward direction.

Likewise, via the pin 60 and the cutter holder 80, the strap cutter 76 is connected to the sealing yoke 34 in such manner that longitudinal motion of the sealing yoke 34 relative to the cutter holder 80 and strap cutter 76 from the withdrawn position (FIG. 1) in the forward direction for a sufficient distance to completely take up lost motion between the sealing yoke 34 and the punch holder 80 (and thus between the sealing yoke 34 and the strap cutter 76) effects longitudinal motion of the strap cutter 76 in the forward direction. The cutter holder 80 and the strap cutter 76 are driven in the forward direction by direct contact between the sealing yoke 34 (at the surface **34*b*, which also faces the cutter holder 80) and the cutter holder 80 (at a surface 80*b*, which faces the sealing yoke 34) when lost motion therebetween has been taken up completely. The sealing yoke 34, the cutter holder 80, and the strap cutter 76 are shown in FIG. 3 in positions where lost motion between the sealing yoke 34 and the cutter holder 80 has been taken up completely from longitudinal motion of the sealing yoke 34 relative to the cutter holder 80 and the strap cutter 76** in the forward direction.

The sealing yoke 34 has walls defining a recess 90, which accommodates the rearwardly extending portion 84 of the cutter holder 80 so as to allow lost motion of the cutter holder 80 relative to the sealing yoke 34, and so as to accommodate a mechanism to be next described for biasing the strap cutter 76 in the forward direction under certain conditions. A flat, plate-like, spring retainer 92 having an aperture 94 via screws 96 is mounted fixedly to the sealing yoke 34. One wall 98 of the walls defining the recess 90 has an aperture 100, which is aligned with the aperture 94 of the spring retainer 92, and which defines an axis. The wall 98 defines the surface **34*b*** described previously.

A plunger 110 is provided, which is made in one piece so as to have three integral portions, namely a working portion 112, a boss portion 114, and a stem portion 116. The working portion, which is cylindrical, extends through the aperture 100 of the wall 98. The plunger 110 is movable axially between an advanced position and a retracted position and is biased toward the advanced position. The plunger 110 is shown in the advanced position, in which the working position 112 extends into the recess 90, in FIG. 2. The plunger 110 is shown in the retracted position, in which the working position 112 is flush with the wall 98, in FIG. 3. The boss portion 114 is adapted to engage the wall 98 at an outer margin 118 around the aperture 100, so as to limit axial motion of the plunger 110 toward the advanced position. The stem portion 116 extends outwardly and integrally from the boss portion 114, through the aperture 94 of the spring retainer 92. A coiled wire spring 120 is disposed around the stem portion 116, between the spring retainer 92 and the boss portion 114, so as to bias the plunger 110 toward the advanced position. Such spring 120 may be pre-loaded compressively.

When the strapping head 30 is operated, the two-stage piston and cylinder mechanism (not shown) causes longitudinal motion of the sealing yoke 34 in the forward direction from the withdrawn position (FIG. 2) into the extended position (FIG. 3) in a manner disclosed in the Pearson patent. Upon longitudinal motion of the sealing yoke 34 from the withdrawn position in the forward direction for a sufficient distance to substantially take up lost motion between the sealing yoke 34 and the strap cutter 76, the working portion 112 of the plunger 110 engages the rearwardly extending portion 84 of the cutter holder 80.

Upon continued motion of the sealing yoke 34 in the forward direction, so as to completely take up lost motion between the sealing yoke 34 and the strap cutter 76, the coiled wire spring 120 is further compressed between the boss portion 114 of the plunger 110 and the spring retainer 92. Furthermore, the strap cutter 76 cooperates with the cutting anvil 72 to cut the outer layer 16 at the sharp corners 74, 78. Once the outer layer 16 has been cut by the strap cutter 76 cooperating with the cutting anvil 72 so as to leave the strap tail 18, the coiled wire spring 120 biases the strap cutter 76, which is free to move in the forward direction because of lost motion allowed by the pin 60 and the longitudinal slot 86 of the cutter holder 80. Thus, as biased by the coiled wire spring 120 and free to move in the forward direction, the strap cutter 76 overtravels for a sufficient distance to flatten the strap tail 18 against the adjacent portion 22 of the tensioned loop 10.

Figure 5:
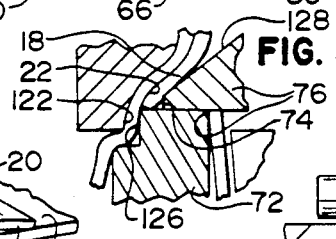
FIG. 5 is an enlarged detail taken from FIG. 4 to show the strap tail, as flattened against the adjacent portion of the tensioned loop, within the strapping head.
Figure 6:
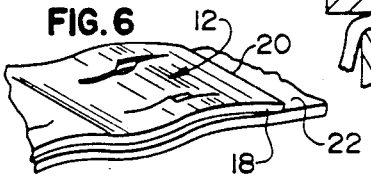
FIG. 6 is a fragmentary, perspective view showing the strap tail, as flattened against the adjacent portion of the tensioned loop, away from the strapping head.

As shown in FIGS. 2, 3, and 4, the sealing dies 32 are shaped so as to define a stepped surface 124, and the cutting anvil 72 is shaped so as to define a recessed surface 126 beyond the sharp corner 74. The adjacent portion 22 of the tensioned loop 10 is deployed so as to be outwardly arched between the stepped surface 124 of the sealing dies 32 and the recessed surface 126 of the cutting anvil 72. The strap cutter 76 has a bevelled surface 128. Such surface 128 engages the strap tail 18 when the strap cutter 76 overtravels, so as to bend the strap tail 18 inwardly against the adjacent portion 22 of the tensioned loop 10 while such portion 22 remains arched outwardly, as shown in FIG. 5. When the sealing head 30 is taken away and the tensioned loop 10 is released under residual tension, the adjacent portion 22 tends to straighten and the strap tail tends to remain bent inwardly against the adjacent portion 22, as shown in FIG. 6.

Figure 8:
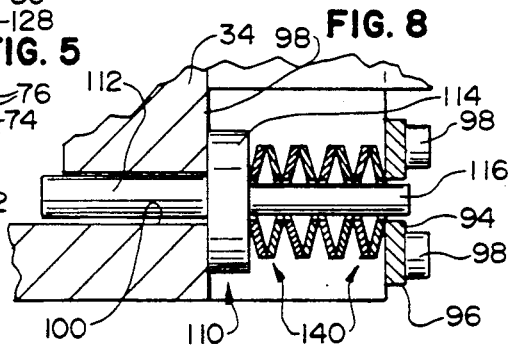
FIG. 8 (on a slightly larger scale) is a fragmentary, cross-sectional view showing a tubular, elastomeric member substituted for the coiled wire spring in the strapping head of FIGS. 2, 3, and 4.
Figure 7:
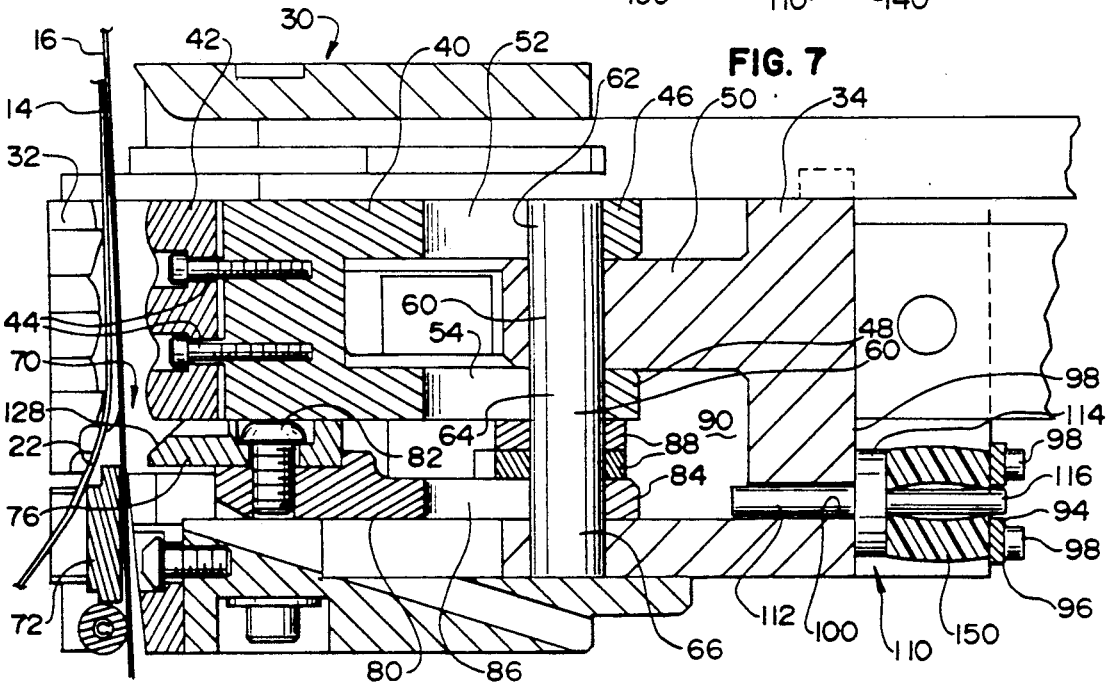
FIG. 7 is a fragmentary, cross-sectional view showing a stack of belleville washers substituted for a coiled wire spring in the strapping head of FIGS. 2, 3, and 4.

As shown in FIG. 8, a stack of belleville washers 140 disposed around the stem portion 116, between the spring retainer 92 and the boss portion 114, are substitutable for the coiled wire spring 120 for biasing the plunger 110 toward the advanced position. As shown in FIG. 7, a tubular, elastomeric member 150 disposed around the stem portion 116, between the spring retainer 92 and the boss portion 114 is substitutable for the coiled wire spring 120 for biasing the plunger 110 toward the advanced position.

Accordingly, in the sealing head 30, the strap cutter 76 and related elements described above for allowing relative motion between the strap cutter 76 and the sealing yoke 34 and for biasing the strap cutter 76 in the forward direction provide the sealing head 30 with an improved capability for flattening a strap tail, such as the strap tail 18.

Figure 9:
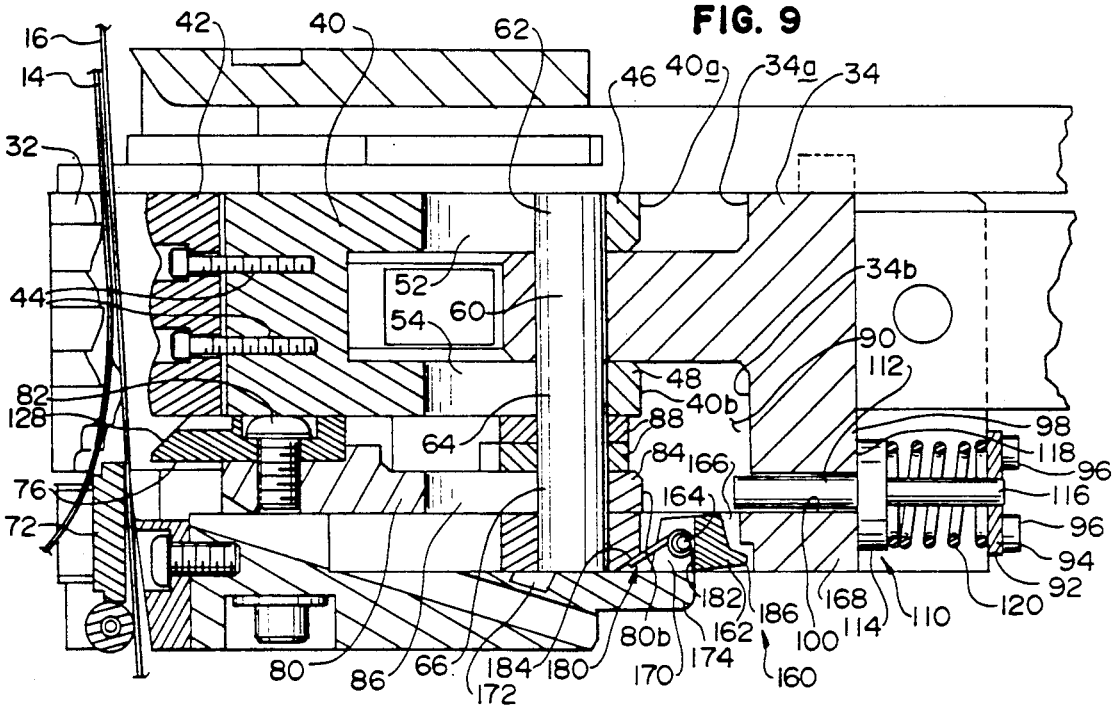
FIG. 9 is a fragmentary, cross-sectional view of certain elements of a strapping head constituting an alternate embodiment of this invention. Among other elements, a sealing yoke, a slitting punch, a strap cutter, and a latching member are shown before slits are punched in two overlapped layers of a tensioned loop. The latching member and related elements differentiate the alternate embodiment from the preferred embodiment.
Figure 10:
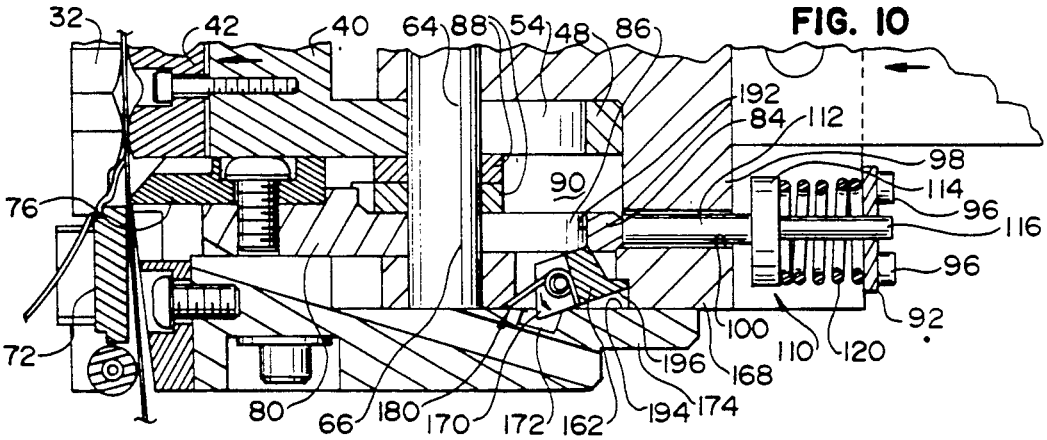
FIG. 10 is a comparable view showing the sealing yoke, the slitting punch, the strap cutter, and the latching member, among other elements, after slits have been punched in the overlapped layers but before the tensioned loop is cut from the remaining strap.
Figure 11:
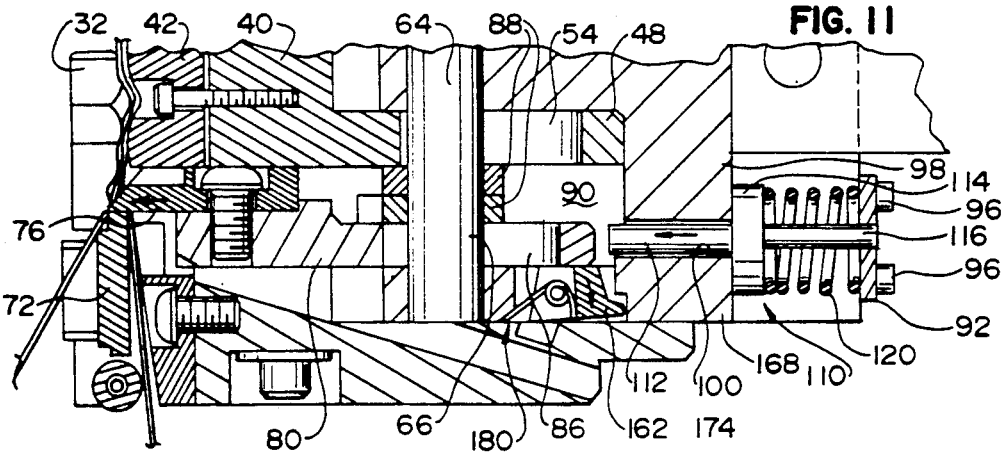
FIG. 11 is a comparable view showing the sealing yoke, the slitting punch, the strap cutter, and the latching member, among other elements, after the tensioned loop has been cut from the remaining strap so as to leave a strap tail and after the strap tail has been flattened against an adjacent portion of the tensioned loop.

As shown in FIGS. 9, 10, and 11, the strapping head 30 has been modified so as to constitute an alternate embodiment of this invention. A mechanism 160 is provided for latching and unlatching the cutter holder 80 under certain conditions. The mechanism 160 latches the cutter holder 80 to the sealing yoke 34, so as to prevent relative motion between the cutter holder 80 and the sealing yoke 34, upon longitudinal motion of the sealing yoke 34, relative to the cutter holder 80 in the forward direction for a sufficient distance to completely take up lost motion between the sealing yoke and the cutter holder. The mechanism 160 unlatches the cutter holder 80 to the sealing yoke 34, so as to allow relative motion between the cutter holder 80 and the sealing yoke 34, upon longitudinal motion of the sealing yoke 34 in the reverse direction from a position where lost motion between the sealing yoke 34 and the cutter holder 80 has been taken up completely. The mechanism 160 prevents the strap cutter 76 from overtravelling until such time as the sealing yoke 34 has begun to move in the reverse direction after the outer layer 16 of steel strap has been cut.

The mechanism 160 comprises a latching pawl 162, which is mounted to the sealing yoke 34, via a pivot pin 164, in an enlarged aperture 166 in one wall 168 of the walls defining the recess 90, so as to be pivotally movable between a latching position and an unlatching position. The latching pawl 162 is shown in the latching position in FIG. 10 and in the unlatching position in FIGS. 9 and 11. In the latching position, a tail portion 170 of the latching pawl 162 extends into a recess 172 formed in an adjacent wall 174 of the sealing head 30. Upon longitudinal motion of the sealing head 30 in either direction, the wall 168 slides along the wall 174. The latching pawl 162 biased toward the latching position by a torsional spring 180 with an arm 182 engaging the latching pawl 162 and an arm 184 engaging the wall 168. The latching pawl 162 has an arm 186, which is adapted to engage a projecting portion 188 of the wall 168 so as to limit pivotal motion of the latching pawl 162 toward the latching position. The latching pawl 162 has a head portion 190, which is adapted to enter the longitudinal slot 86 of the cutter holder 80, so as to engage a rear margin 192 of such slot 86 if the cutter holder 80 is positioned at its limit of lost motion in the reverse direction and if the latching pawl 162 is pivoted to the latching position. The wall 174 defines a camming surface 194, which extends in the reverse direction from the recess 172 in the wall 174, and the latching pawl 162 defines a camming surface 196, which faces the wall 174.

When the sealing yoke 34 is disposed in the withdrawn position (see FIG. 9) the camming surface 196 of the latching pawl 162 bears against the camming surface 194 of the wall 174 so as to retain the latching pawl 162 in the unlatching position. Upon longitudinal motion of the sealing yoke 34 from the withdrawn position in the forward direction to a position where lost motion between the sealing yoke 34 and the strap cutter 76 has been taken up sufficiently to permit the latching pawl 162 to pivot from the unlatching position (see FIG. 10)

the latching pawl 162 is pivoted by the torsional spring 180 so that the tail portion 170 enters the recess 90, which because of such motion of the sealing yoke 34 has become disposed to receive the tail portion 170. Simultaneously, the head portion 190 enters the longitudinal slot 86 of the cutter holder 80 and engages the rear margin 192 of such slot 86, which because of such motion of the sealing yoke 34 has become disposed to receive the head portion 190. Upon longitudinal motion of the sealing yoke 34 in the reverse direction from the position when lost motion between the sealing yoke 34 and the strap cutter 76 has been taken up sufficiently to permit the latching pawl 162 to pivot from the unlatching position (see FIG. 11) the camming surface 194 of the wall 174 and the camming surface 196 of the latching pawl 162 cooperate to cam the latching pawl from the latching position into the unlatching position so as to allow the strap cutter 76 to overtravel and to flatten the strap tail 18, as described above.

Accordingly, if the latching pawl 162 and related elements are provided in the strapping head 30, the strap cutter 76 is prevented from overtravelling until such time as the sealing yoke 34 has begun to move in the reverse direction after the strap cutter 76 has cut the outer layer 16 of steel strap.

Various other modifications may be made in the disclosed embodiments without departing from the scope and spirit of this invention.

I claim:

1. In a strapping head, in which a connection is made in two overlapped layers of steel strap in a tensioned loop with the overlapped layers including an inner layer and an outer layer, a combination comprising:

(a) a sealing yoke mounted in the strapping head so as to permit longitudinal motion of the sealing yoke in a forward direction and in a reverse direction;

(b) means for cutting the outer layer of steel strap so as to cut the tensioned loop from the remaining strap and so as to leave a strap tail, the cutting means comprising a cutting anvil and a strap cutter, the cutting anvil being mounted in the strapping head, in a fixed position, the cutting anvil being positionable between the inner and outer layers of steel strap, the strap cutter being mounted in the strapping head so as to permit longitudinal motion of the strap cutter relative to the sealing yoke in the forward direction and in the reverse direction, the strap cutter being adapted to cooperate with the cutting anvil to cut the outer layer of steel strap upon longitudinal motion of the strap cutter past the cutting anvil in the forward direction;

(c) means for connecting the strap cutter to the sealing yoke so as to allow lost motion between the strap cutter and the sealing yoke, the connecting means being arranged in such manner that longitudinal motion of the sealing yoke relative to the strap cutter in the forward direction for a sufficient distance to completely take up lost motion between the sealing yoke and the strap cutter effects longitudinal motion of the strap cutter in the forward direction; and (d) means for biasing the strap cutter in the forward direction upon longitudinal motion of the sealing yoke in the forward direction for a sufficient direction to substantially take up lost motion between the sealing yoke and the strap cutter, the biasing means biasing the strap cutter so as to cause the strap cutter to overtravel for a sufficient distance to flatten the strap tail against an adjacent portion of the tensioned loop, after the outer layer of steel strap has been cut.

2. In a strapping head for a strapping machine, in which a sealless connection is made in two overlapped layers of steel strap in a tensioned loop with the overlapped layers including an inner layer and an outer layer, a combination comprising:

(a) a set of slitting dies mounted in the strapping head and positionable behind the inner layer of steel strap;

(b) a sealing yoke mounted in the strapping head so as to permit longitudinal motion of the sealing yoke relative to the slitting dies in a forward direction and in a reverse direction;

(c) a slitting punch mounted in the strapping head so as to permit longitudinal motion of the slitting punch relative to the sealing yoke in the forward direction, toward the slitting dies, and in the reverse direction, away from the slitting dies;

(d) means for cutting the outer layer of steel strap so as to cut the tensioned loop from the remaining strap and so as to leave a strap tail, the cutting means comprising a cutting anvil and a strap cutter, the cutting anvil being mounted in the strapping head, in a fixed position, the cutting anvil being positionable between the inner and outer layers of steel strap, the strap cutter being mounted in the strapping head so as to permit longitudinal motion of the strap cutter relative to the sealing yoke in the forward direction and in the reverse direction, the strap cutter being adapted to cooperate with the cutting anvil to cut the outer layer of steel strap upon longitudinal motion of the strap cutter past the cutting anvil in the forward direction;

(e) means for connecting the slitting punch to the sealing yoke so as to allow lost motion between the sealing yoke and the slitting punch and for connecting the strap cutter to the sealing yoke so as to allow lost motion between the strap cutter and the sealing yoke, the connecting means allowing relative motion between the strap cutter and the punch holder, the connecting means being arranged in such manner that longitudinal motion of the sealing yoke relative to the slitting punch in the forward direction for a sufficient distance to completely take up lost motion between the sealing yoke and the slitting punch effects longitudinal motion of the slitting punch in the forward direction, the connecting means being arranged in such manner that longitudinal motion of the sealing yoke relative to the strap cutter in the forward direction for a sufficient distance to completely take up lost motion between the sealing yoke and the strap cutter effects longitudinal motion of the strap cutter in the forward direction; and (f) means for biasing the strap cutter in the forward direction upon longitudinal motion of the sealing yoke in the forward direction for a sufficient distance to substantially take up lost motion between the sealing yoke and the strap cutter, the biasing means biasing the strap cutter so as to cause the strap cutter to overtravel for a sufficient distance to flatten the strap tail against an adjacent portion of the tensioned loop, after the outer layer of steel strap has been cut.

3. The combination of claim 2 wherein the cutting means comprises a punch holder connected to the sealing yoke so as to permit longitudinal motion of the punch holder relative to the sealing yoke in the forward direction and in the reverse direction, the slitting punch being mounted to the punch holder so as to be conjointly movable with the punch holder, and a cutter holder connected to the sealing yoke so as to permit longitudinal motion of the cutter holder relative to the sealing yoke in the forward direction and in the reverse direction, the strap cutter being mounted to the cutter holder so as to be conjointly movable with the cutter holder, and wherein the punch holder has at least one longitudinal slot and the cutter holder has a longitudinal slot and wherein the connecting means comprises a pin mounted to the sealing yoke so as to be conjointly movable with the sealing yoke, the pin extending through the longitudinal slots of the punch holder and the cutter holder so as to allow lost motion between the sealing yoke and the slitting punch and between the sealing yoke and the strap cutter within limits defined by the respective slots.

4. The combination of claim 3 wherein the sealing yoke has walls defining a recess accommodating a portion of the cutter holder so as to allow lost motion of the strap cutter relative to the sealing yoke, one said wall having a longitudinally extending aperture defining an axis, and wherein the sealing yoke has a spring retainer integral with the sealing yoke, the biasing means comprising a plunger having a working portion extending through the longitudinal aperture so as to be axially movable between an advanced position of the plunger and a retracted position of the plunger, the working portion projecting into the recess in the advanced position and being adapted to engage the cutter holder, at the portion accommodated by the recess, upon longitudinal motion of the sealing yoke in the forward direction for a sufficient distance to substantially take up lost motion between the sealing yoke and the cutter holder, the plunger having a boss portion integral with the working portion and adapted to engage said one wall so as to limit axial movement of the plunger toward the advanced position, the biasing means comprising a spring means loaded between the spring retainer and the boss portion so as to bias the pin toward the advanced position.

5. The combination of claim 4 wherein the plunger has a stem portion integral with the boss portion and a coiled wire spring member, which is disposed around the stud, between the spring retainer and the boss portion.

6. The combination of claim 4 wherein the plunger has a stem portion integral with the boss portion and a stack of belleville washers, which are disposed around the stud, between the spring retainer and the head of the pin.

7. The combination of claim 4 wherein the plunger has a stem portion integral with the boss portion and a tubular elastomeric member, which is disposed around the stud, between the spring retainer and the boss portion.

8. The combination of claim 3 comprising means for latching the cutter holder to the sealing yoke so as to prevent relative motion between the cutter holder and the sealing yoke, upon longitudinal motion of the sealing yoke relative to the cutter holder in the forward direction for a sufficient distance to at least substantially take up lost motion between the sealing yoke and the cutter holder, and for unlatching the cutter holder from the sealing yoke so as to allow relative motion between the cutter holder and the sealing yoke, upon longitudinal motion of the sealing yoke relative to the cutter holder in the reverse direction from a position where lost motion between the sealing yoke and the cutter holder has been taken up at least substantially.

9. The combination of claim 8 wherein the latching and unlatching means comprises a latching member, which is mounted to the sealing yoke so as to be pivotally movable between a latching position and an unlatching position, means for biasing the latching member to the latching position, and means for camming the latching member from the latching position into the unlatching position upon longitudinal motion of the sealing yoke relative to the cutter holder in the reverse direction from the position where lost motion between the sealing yoke and the cutter holder has been taken up at least substantially, the latching member extending into the longitudinal slot of the cutter holder and engaging the cutter holder so as to prevent relative motion of the cutter holder and the sealing yoke when pivoted to the latching position, the latching member being disengaged from the cutter holder so as to allow relative motion between the cutter holder and the sealing yoke when pivoted to the unlatching position.

* * * * *